US007708657B2

(12) United States Patent
Yokota et al.

(10) Patent No.: US 7,708,657 B2
(45) Date of Patent: May 4, 2010

(54) GOLF BALL

(75) Inventors: Masatoshi Yokota, Kobe (JP); Koichi Fujisawa, Kobe (JP); Kazuhiko Isogawa, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 11/401,899

(22) Filed: Apr. 12, 2006

(65) Prior Publication Data

US 2006/0264270 A1 Nov. 23, 2006

(30) Foreign Application Priority Data

May 17, 2005 (JP) ..... 2005-143518

(51) Int. Cl.
*A63B 37/12* (2006.01)

(52) U.S. Cl. ..... 473/383

(58) Field of Classification Search ..... 473/373, 473/374, 383–385
See application file for complete search history.

(56) References Cited

U.S. PATENT DOCUMENTS 4,337,946 A 7/1982 Saito et al.
5,820,487 A * 10/1998 Nakamura et al. ..... 473/374
5,823,890 A 10/1998 Maruko et al.
6,155,935 A 12/2000 Maruko
6,162,852 A * 12/2000 Honeycutt et al. ..... 524/423
6,213,897 B1 * 4/2001 Masutani ..... 473/378
6,290,797 B1 * 9/2001 Gosetti et al. ..... 155/228
6,699,027 B2 * 3/2004 Murphy et al. ..... 425/116
2003/0092510 A1 5/2003 Iwami et al.
2003/0130066 A1 7/2003 Sasaki
2003/0211904 A1 11/2003 Iwami et al.
2004/0162159 A1 * 8/2004 Kawamatsu ..... 473/371

FOREIGN PATENT DOCUMENTS

JP 56-68466 6/1981
JP 11-299931 11/1999
JP 2000-000330 1/2000
JP 2003-019228 1/2003
JP 2003-135626 5/2003
JP 2004-337231 12/2004

* cited by examiner

*Primary Examiner*—Raeann Trimiew
(74) *Attorney, Agent, or Firm*—Birch, Stewart, Kolasch & Birch, LLP

(57) ABSTRACT

Golf ball 2 has a center 4, a mid layer 6, a reinforcing layer 8 and a cover 10. Base polymer of the mid layer 6 includes an ionomer resin as a principal component. A melting point of the resin composition is equal to or greater than 95° C. The mid layer 6 has a thickness of 0.5 mm or greater and 2.5 mm or less. The cover 10 includes a thermoplastic resin. The cover 10 has a nominal thickness Tc of 0.1 mm or greater and 0.9 mm or less. The mid layer 6 has recessed parts which correspond to dimples 12. In the golf ball 2, the resin composition of the mid layer 6 does not flow out from a seam when forming the cover 10.

7 Claims, 4 Drawing Sheets

GOLF BALL

This application claims priority on Patent Application No. 2005-143518 filed in JAPAN on May 17, 2005. The entire contents of which are hereby incorporated by reference.

BACKGROUND OF THE INVENTION

1. Field of the Invention

The present invention relates to golf balls. More particularly, the present invention relates to multi piece golf balls having a core, a mid layer and a cover.

2. Description of the Related Art

Top concern to golf players for golf balls is their flight performances. The golf players particularly place great importance on flight distance attained upon shots with a driver. The golf players also place great importance on flight distance attained upon shots with a long iron and a middle iron.

Golf balls have numerous dimples on the surface thereof. The dimples cause turbulent flow separation through disrupting the air flow around the golf ball during the flight. By causing the turbulent flow separation, a separating point of air from the golf ball shifts backwards leading to the reduction of a drag. The turbulent flow separation promotes the differentia between upper separating point and lower separating point of the golf ball, which results from the backspin, thereby enhancing the lift force that acts upon the golf ball. The dimples are responsible for flight distance.

Golf players also place great importance on spin performances of golf balls. Great back spin rate results in small run. For golf players, golf balls which are liable to be spun backwards are apt to be rendered to stop at a targeted position. Great side spin rate results in easily curved trajectory of the golf ball. For golf players, golf balls which are liable to be spun sidewise are apt to allow their trajectory to curve intentionally. Golf balls that are excellent in spin performances are excellent in control performances. High-level golf players particularly place great importance on control performances upon shots with a short iron.

For golf players, durability of golf balls is also important. Golf balls that are not damaged by repeated hitting have been desired. Further, golf balls that are resistant to generation of cuts and wrinkles on the cover upon full shots with a short iron have been desired.

In light of the flight performances, control performances and durability, a variety of improvement relating multi piece golf balls have been proposed. For example, U.S. Pat. No. 5,823,890 (Japanese Patent No. 3000918 B) proposes a golf ball having a spherical center, a mid layer comprising an ionomer resin which is obtained by compression molding and a cover comprising an ionomer resin which is obtained by compression molding.

Examples of methods of covering a core with a cover include compression molding and injection molding. In injection molding, a core is held in a cavity of a mold. Around the core, a melted cover material is injected. In compression molding, a bowl-shaped half shell comprising a cover material is formed. A core is covered by two half shells. The core and the half shells are compressed and heated in a mold.

In general, a resilience performance of a resin used for a cover is inferior to a resilience performance of rubber used for a center. In light of a resilience performance of a golf ball, a thin cover is preferred. In injection molding, a thickness of a cover depends on the distance between a core and a cavity face. To form a thin cover by injection molding is difficult. Thus, compression molding is adopted to form thin covers. In this compression molding, however, a mid layer material also melts when being compressed and heated. In compression molding, it is likely that the melted mid layer material flows out from a seam of two half shells. When the outflow is generated, appearance of a golf ball is impaired by exposing the mid layer on a seam line of the golf ball. Further, when the golf ball is repeatedly hit, the exposed mid layer easily cracks, which may break the cover. The exposure deteriorates durability of the golf ball.

As mentioned above, golf balls have numerous dimples on the surface thereof. The dimples are recessed and a thickness of the cover immediately below the dimples is less than a thickness of the cover immediately below a land. When golf balls have a small nominal thickness of the cover, a thickness of the cover immediately below the dimples is particularly thin. As a result, the mid layer can be exposed at the bottom of dimples or seen through. Further, separating, cutting and cracks of the cover immediately below dimples are liable to be generated.

An object of the present invention is to provide golf balls with favorable appearance and durability.

SUMMARY OF THE INVENTION

A golf ball according to the present invention has a spherical center, amid layer positioned outside of this center, and a cover positioned outside of this mid layer and having numerous dimples on the surface thereof. The mid layer includes a thermoplastic resin. A melting point of the mid layer is equal to or greater than 95° C. A thickness of the mid layer is 0.5 mm or greater and 0.9 mm or less. This mid layer has recessed parts on the surface thereof which correspond to the dimples. The cover includes a thermoplastic resin. A nominal thickness Tc of the cover is 0.1 mm or greater and 0.9 mm or less. Preferably, the mid layer includes an ionomer resin.

The method of the production of a golf ball according to the present invention comprises:

(1) a first step in which a spherical center is formed;

(2) a second step in which a mid layer material including a thermoplastic resin and having a melting point of equal to or greater than 95° C. is prepared;

(3) a third step in which said center is covered by said mid layer material to form the mid layer;

(4) a fourth step in which a cover material including a thermoplastic resin is prepared;

(5) a fifth step in which a half shell is formed by said cover material;

(6) a sixth step in which a core comprising said center and said mid layer is covered by two pieces of half shells and placed into a mold having numerous pimples; and (7) a seventh step in which said core and said half shells are compressed and heated, and a cover having dimples on the surface thereof which correspond to said pimples is formed, and recessed parts which correspond to the dimples are formed on the mid layer.

Preferably, the mid layer material which is prepared in the second step includes an ionomer resin.

In the third step, a melted mid layer material is injected around the center which is held in the mold.

The third step may comprise a step in which the center is covered by two pieces of half shells comprising the mid layer material; and a step in which the center and the half shells are compressed and heated in the mold.

In a golf ball according to the present invention, a cover with a small nominal thickness may be responsible for the flight performances. Because this golf ball has a mid layer with a melting point of equal to or greater than 95° C., the outflow of a mid layer material from a seam is suppressed. In this golf ball, the mid layer is not exposed on a seam line. The mid layer of this golf ball does not easily crack. By having recessed parts, the mid layer archives a sufficient thickness of the cover immediately below dimples. The sufficient thickness of a cover is responsible for appearance of a bottom of the dimples. Further, the sufficient thickness of a cover suppresses separating, cuts and cracks of a cover. This golf ball is excellent in appearance and durability although a nominal thickness of the cover is small.

DESCRIPTION OF THE PREFERRED EMBODIMENTS

The present invention is hereinafter described in detail with appropriate references to the accompanying drawing according to the preferred embodiments.

Figure 1:
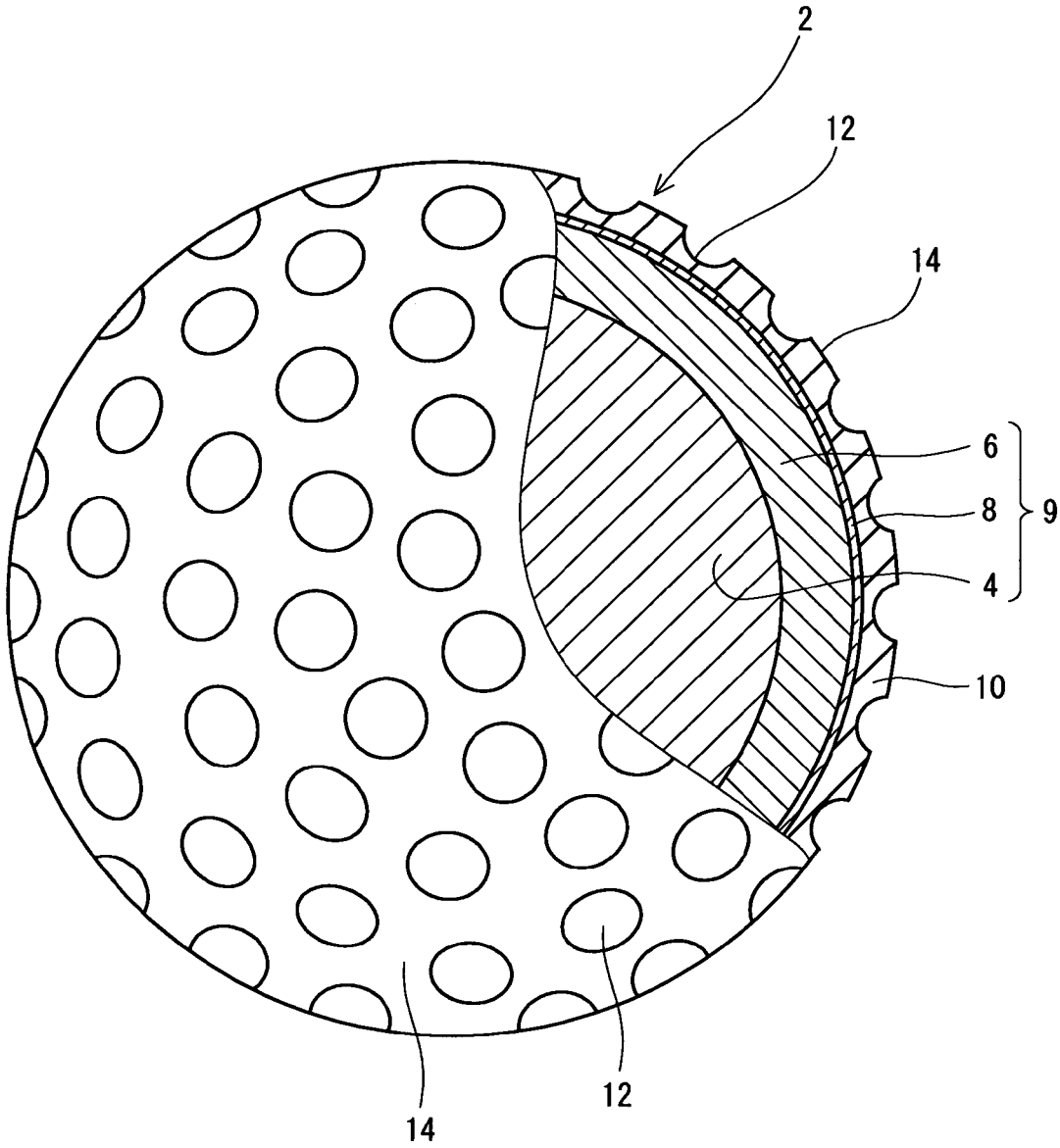
FIG. 1 is a partially cut off cross-sectional view illustrating a golf ball according to one embodiment of the present invention.

A golf ball depicted in FIG. 1 has a spherical center 4, a mid layer 6 covering this center 4, a reinforcing layer 8 covering this mid layer 6, and a cover 10 covering this reinforcing layer 8. A core 9 comprises the center 4, the mid layer 6 and the reinforcing layer 8. Numerous dimples 12 are formed on the surface of the cover 10. Of the surface of the cover 10, a part except for the dimples 12 is a land 14. Although this golf ball 2 has a paint layer and a mark layer to the external side of the cover 10, these layers are not shown in the Figure.

This golf ball 2 has a diameter of from 40 mm to 45 mm. From the standpoint of conformity to a rule defined by United States Golf Association (USGA), the diameter is preferably equal to or greater than 42.67 mm. In light of suppression of the air resistance, the diameter is preferably equal to or less than 44 mm, and more preferably equal to or less than 42.80 mm. Weight of this golf ball 2 is 40 g or greater and 50 g or less. In light of attainment of great inertia, the weight is preferably equal to or greater than 44 g, and more preferably equal to or greater than 45.00 g. From the standpoint of conformity to a rule defined by USGA, the weight is preferably equal to or less than 45.93 g.

The center 4 is usually obtained through crosslinking of a rubber composition. Examples of preferred base rubber include polybutadienes, polyisoprenes, styrene-butadiene copolymers, ethylene-propylene-diene copolymers and natural rubbers. In light of the resilience performance, polybutadienes are preferred. When other rubber is used in combination with polybutadiene, it is preferred that polybutadiene is included as a principal component. Specifically, the proportion of polybutadiene occupying in total base rubber is preferably equal to or greater than 50% by weight, and particularly preferably equal to or greater than 80% by weight. Polybutadienes, which have a percentage of cis-1,4 bond of equal to or greater than 40%, and particularly equal to or greater than 80%, are preferred, in particular.

For crosslinking of the center 4, a co-crosslinking agent is usually used. Preferable co-crosslinking agent in light of the resilience performance is a monovalent or bivalent metal salt of an α,β-unsaturated carboxylic acid having 2 to 8 carbon atoms. Specific examples of preferable co-crosslinking agent include zinc acrylate, magnesium acrylate, zinc methacrylate and magnesium methacrylate. Zinc acrylate and zinc methacrylate are particularly preferred on the ground that a high resilience performance can be achieved.

As a co-crosslinking agent, an α,β-unsaturated carboxylic acid having 2 to 8 carbon atoms, and an oxidized metal may be blended. Both components react in the rubber composition to give a salt. This salt is responsible for the crosslinking reaction. Examples of preferable α,β-unsaturated carboxylic acid include acrylic acid and methacrylic acid. Examples of preferable oxidized metal include zinc oxide and magnesium oxide.

In light of the resilience performance of the golf ball 2, the amount of the co-crosslinking agent to be blended is preferably equal to or greater than 10 parts by weight, and more preferably equal to or greater than 15 parts by weight per 100 parts by weight of the base rubber. In light of soft feel at impact, the amount of the co-crosslinking agent to be blended is preferably equal to or less than 50 parts by weight, and more preferably equal to or less than 45 parts by weight per 100 parts by weight of the base rubber.

It is preferred that a crosslinking initiator is blended together with the co-crosslinking agent into the rubber composition for use in the center 4. Examples of crosslinking initiators include organic peroxide. By blending the organic peroxide, the resilience performance of the golf ball 2 may be improved. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide. Particularly versatile organic peroxide is dicumyl peroxide.

In light of the resilience performance of the golf ball 2, the amount of the organic peroxide to be blended is preferably equal to or greater than 0.1 part by weight, more preferably equal to or greater than 0.3 part by weight, and particularly preferably equal to or greater than 0.5 part by weight per 100 parts by weight of the base rubber. In light of the soft feel at impact, the amount of the organic peroxide to be blended is preferably equal to or less than 3.0 parts by weight, and more preferably equal to or less than 2.5 parts by weight per 100 parts by weight of the base rubber.

A filler may be blended into the center 4 for the purpose of adjusting specific gravity and the like. Illustrative examples of suitable filler include zinc oxide, barium sulfate, calcium carbonate and magnesium carbonate. Also, powder consisting of a highly dense metal may be blended as a filler. Specific examples of the highly dense metal include tungsten and molybdenum. The amount of the filler to be blended is determined ad libitum so that intended specific gravity of the center 4 can be accomplished. Particularly preferable filler is zinc oxide. Zinc oxide serves not only in adjusting specific gravity but also as a crosslinking activator. Various kinds of additives such as sulfur, a sulfur compound, an anti-aging agent, a coloring agent, a plasticizer, a dispersant and the like may be blended in an appropriate amount to the center 4 as needed. The center 4 may be also blended with crosslinked rubber powder or synthetic resin powder.

Amount of compressive deformation of the center 4 is preferably equal to or less than 5.0 mm, more preferably equal to or less than 4.5 mm, and particularly preferably equal to or less than 4.0 mm. When the golf ball 2 is hit with a driver, the center 4 is also deformed greatly in conjunction with the cover 10 and the mid layer 6. The center 4 having a small amount of compressive deformation is responsible for a flight performance upon a shot with a driver. The center 4 having a too small amount of compressive deformation deteriorates the feel at impact of the golf ball 2. In light of the feel at impact, the amount of compressive deformation is preferably equal to or greater than 1.5 mm, and particularly preferably equal to or greater than 2.0 mm.

The center 4 preferably has a diameter of 25.0 mm or greater and 41.5 mm or less. The center 4 preferably has a weight of 25 g or greater and 42 g or less. Crosslinking temperature of the center 4 is usually 140° C. or greater and 180° C. or less. The crosslinking time period of the center 4 is usually 10 minutes or longer and 60 minutes or less. The center 4 may be formed with two or more layers. Other layer comprising a resin composition or a rubber composition may be provided between the center and the mid layer.

The mid layer 6 comprises a thermoplastic resin composition. Illustrative examples of the base polymer of the thermoplastic resin composition include ionomer resins, ethylene-vinyl acetate copolymer resins (EVA), polyethylene resins, polypropylene resins, thermoplastic polyester elastomers, thermoplastic polyamide elastomers, thermoplastic polyurethane elastomers, thermoplastic polyolefin elastomers and thermoplastic polystyrene elastomers. In light of high elasticity, ionomer resins are preferred. Ionomer resins are responsible for flight performances. The ionomer resin and other resin may be used in combination. When the ionomer resin and the other resin are used in combination, it is preferable that the ionomer resin is included as a principal component. Specifically, proportion of the ionomer resin occupying in the total base polymer is preferably equal to or greater than 50% by weight, more preferably equal to or greater than 70% by weight, and particularly preferably equal to or greater than 85% by weight.

Examples of preferred ionomer resin include binary copolymers formed with α-olefin and an α,β-unsaturated carboxylic acid having 3 to 8 carbon atoms. Preferable examples of the other ionomer resin include ternary copolymers formed with α-olefin, an α,β-unsaturated carboxylic acid having 3 to 8 carbon atoms and an α,β-unsaturated carboxylate ester. In the binary copolymer and ternary copolymer, preferable α-olefin may be ethylene and propylene, while preferable α,β-unsaturated carboxylic acid may be acrylic acid, methacrylic acid, fumaric acid, maleic acid and crotonic acid. Preferable α,β-unsaturated carboxylate ester may be acrylic acid, methacrylic acid, fumaric acid and maleic acid which are methyl ester, ethyl ester, propyl ester, n-butane ester and isobutyl ester. In the binary copolymer and ternary copolymer, a part of the carboxyl group may be neutralized with a metal ion. Illustrative examples of the metal ion for use in neutralization include sodium ion, potassium ion, lithium ion, zinc ion, calcium ion, magnesium ion, aluminum ion and neodymium ion. The neutralization may be carried out with two or more kinds of metal ions. Particularly suitable metal ion in light of the resilience performance and durability of the golf ball is sodium ion, zincion, lithium ion and magnesium ion.

As described later, a melting point of a mid layer material is equal to or greater than 95° C. Accordingly, it is preferable to use the ionomer resin with a melting point of equal to or greater than 95° C. for the mid layer. Examples of the ionomer resin with a melting point of equal to or greater than 95° C. include trade names "Himilan 1554" (melting point: 97° C.), "Himilan 1555" (melting point: 95° C.), "Himilan 1557" (melting point: 95° C.), "Himilan 1601" (melting point: 97° C.), "Himilan 1652" (melting point: 98° C.) and "Himilan AM79102" (melting point: 102° C.), available from Du Pont-MITSUI POLYCHEMICALS Co., Ltd.; trade names "Surlyn® 8670" (melting point: 100° C.), available from Dupont Co. Two or more kinds of ionomer resins may be used in combination. The ionomer resin with a melting point of equal to or greater than 95° C. and the ionomer resin with the melting point of less than 95° C. may be used in combination. Illustrative examples of the ionomer resins with a melting point of less than 95° C. include trade names "Himilan 1605" (melting point: 92° C.) and "Himilan AM7329" (melting point: 89° C.), available from Du Pont-MITSUI POLYCHEMICALS Co., Ltd.

Into the resin composition of the mid layer 6 may be blended a filler for the purpose of adjusting specific gravity and the like. Illustrative examples of suitable filler include zinc oxide, barium sulfate, calcium carbonate and magnesium carbonate. Powder of a highly dense metal may be also blended as a filler. Specific examples of the highly dense metal include tungsten and molybdenum. The amount of the filler to be blended is determined ad libitum so that the intended specific gravity of the mid layer 6 can be accomplished. Into the mid layer 6 may be also blended a coloring agent, crosslinked rubber powder or synthetic resin powder.

A melting point Tt of the resin composition of the mid layer 6 is 95° C. or greater and 120° C. or less. The resin composition with the melting point Tt of 95° C. or greater does not easily flow out from a seam when forming the cover. This resin composition is responsible for appearance and durability of the golf ball. In this respect, the melting point Tt is more preferably equal to or greater than 96° C. and particularly preferably equal to or greater than 97° C. By using a resin composition with the melting point Tt of equal to or less than 120° C. for the mid layer, a thin cover 10 can be easily formed. A melting point is measured by differential scanning calorimetry (DSC).

In light of the flight performance upon a shot with a driver, the mid layer 6 has an ominal thickness Tm of preferably 0.5 mm or greater and 2.5 mm or less. A mid layer with a nominal thickness Tm of equal to or greater than 0.5 mm is responsible for durability. A mid layer with a nominal thickness Tm of 2.5 mm or less is responsible for resilience performances and flight performances. The nominal thickness Tm is measured at a place except for immediately below the dimple 12.

In light of adhesion between the mid layer 6 and the reinforcing layer 8, the surface of the mid layer 6 is preferably subjected to a surface treatment to increase the roughness thereof. Specific examples of the treatment include brushing, grinding and the like.

The reinforcing layer 8 lies between the mid layer 6 and the cover 10. As described later, the cover 10 of this golf ball 2 is very thin. When such a thin cover 10 is hit with a short iron, a wrinkle is liable to be generated. The wrinkle is generated by displacement of the cover 10 with respect to the mid layer 6. The reinforcing layer 8 prevents the displacement of the cover 10 with respect to the mid layer 6, and prevents cutting of the cover 10 immediately below the dimple 12. Presence of the reinforcing layer 8 results in suppression of generation of the wrinkle. Furthermore, the reinforcing layer 8 firmly adheres to the mid layer 6, and also adheres firmly to the cover 10. The reinforcing layer 8 suppresses breakage of the cover 10. The golf ball 2 having the reinforcing layer 8 is excellent in durability.

For the base polymer of the reinforcing layer 8, a two-component cured thermosetting resin may be suitably used. Specific examples of the two-component cured thermosetting resin include epoxy resins, urethane resins, acrylic resins, polyester based resins and cellulose based resins. In light of the mechanical strength (e.g., strength at break) and durability of the reinforcing layer 8, two-component cured epoxy resins and two-component cured urethane resins are preferred.

The two-component cured epoxy resin is obtained by curing an epoxy resin with a polyamide based curing agent. Illustrative examples of the epoxy resin for use in the two-component cured epoxy resin include bisphenol A type epoxy resin, bisphenol F type epoxy resin and bisphenol AD type epoxy resin. In light of the balance among softness, chemical resistance, heat resistance and toughness, the bisphenol A type epoxy resin is preferred. The bisphenol A type epoxy resin is obtained by a reaction of bisphenol A with an epoxy group-containing compound such as epichlorohydrin.

The polyamide based curing agent has multiple amino groups and one or more amide groups. This amino group can react with an epoxy group. Specific examples of the polyamide based curing agent include polyamide amine curing agents and denatured products of the same. The polyamide amine curing agent is obtained by a condensation reaction of a polymerized fatty acid with a polyamine.

Upon mixing of the epoxy resin and the polyamide based curing agent, ratio of epoxy equivalent of the epoxy resin and amine active hydrogen equivalent of the polyamide based curing agent is preferably 1.0/1.4 or greater and 1.0/1.0 or less.

The two-component cured urethane resin is obtained by a reaction of a base material and a curing agent. A two-component cured urethane resin obtained by a reaction of a base material containing a polyol component with a curing agent containing polyisocyanate or a derivative thereof, or a two-component cured urethane resin obtained by a reaction of a base material containing isocyanate group-ended urethane prepolymer with a curing agent having an active hydrogen may be used.

It is preferred that an urethane polyol is used as the polyol component of the base material. The urethane polyol has urethane bonds and at least two or more hydroxyl groups. The urethane polyol may be obtained by allowing a polyol and polyisocyanate to react at a ratio such that an excessive molar ratio of the hydroxyl group of the polyol component to the isocyanate group of polyisocyanate is attained.

The reinforcing layer 8 may include additives such as a coloring agent (typically, titanium dioxide), a phosphate based stabilizer, an antioxidant, a light stabilizer, a fluorescent brightening agent, an ultraviolet absorbent, a blocking preventive agent and the like. The additive may be added to the base material of the two-component cured thermosetting resin, or may be added to the curing agent.

The reinforcing layer 8 is obtained by coating a liquid which is prepared by dissolving or dispersing the base material and the curing agent in a solvent, on the surface of the mid layer 6. In light of the workability, coating with a spray gun is preferred. The solvent is volatilized after the coating to permit a reaction of the base material with the curing agent thereby forming the reinforcing layer 8. Illustrative examples of preferred solvent include toluene, isopropyl alcohol, xylene, methyl ethyl ketone, methyl isobutyl ketone, ethylene glycol monomethyl ether, ethylbenzene, propylene glycol monomethyl ether, isobutyl alcohol and ethyl acetate.

In light of the durability of the golf ball 2, the reinforcing layer 8 has a thickness of preferably equal to or greater than 0.003 mm, and more preferably equal to or greater than 0.005 mm. In light of easy formation of the reinforcing layer 8, it is preferred that the thickness is equal to or less than 0.30 mm, still more, equal to or less than 0.10 mm, yet more, equal to or less than 0.05 mm, and further, equal to or less than 0.02 mm. The thickness is measured by observation of the cross section of the golf ball 2 with a micro scope.

The cover 10 comprises a thermoplastic resin composition. As a base polymer of this resin composition, a thermoplastic polyurethane elastomer is preferred. Thermoplastic polyurethane elastomers are soft. Great spin rate is achieved when the golf ball 2 having the cover 10 which comprises the thermoplastic polyurethane elastomer is hit with a short iron. The cover 10 comprising a thermoplastic polyurethane elastomer is responsible for a control performance upon a shot with a short iron. The thermoplastic polyurethane elastomer is also responsible for the scuff resistance of the cover 10.

The thermoplastic polyurethane elastomer includes a polyurethane component as a hard segment, and a polyester component or a polyether component as a soft segment. Illustrative examples of the curing agent for the polyurethane component include alicyclic diisocyanate, aromatic diisocyanate and aliphatic diisocyanate. In particular, alicyclic diisocyanate is preferred. Because the alicyclic diisocyanate has no double bond in the main chain, yellowing of the cover 10 can be suppressed. Additionally, because the alicyclic diisocyanate is excellent in strength, the cover 10 can be prevented from being scuffed. Two or more kinds of diisocyanates may be used in combination.

Illustrative examples of the alicyclic diisocyanate include 4,4'-dicyclohexylmethane diisocyanate ($H_{12}$MDI), 1,3-bis (isocyanatomethyl)cyclohexane ($H_6$XDI), isophorone diisocyanate (IPDI) and trans-1,4-cyclohexane diisocyanate (CHDI). In light of versatility and processability, $H_{12}$MDI is preferred.

Illustrative examples of the aromatic diisocyanate include 4,4'-diphenylmethane diisocyanate (MDI) and toluene diisocyanate (TDI). Illustrative examples of the aliphatic diisocyanate include hexamethylene diisocyanate (HDI).

Specific examples of the thermoplastic polyurethane elastomer include trade name "Elastollan XNY90A", trade name "Elastollan XNY97A", trade name "Elastollan XNY585" and trade name "Elastollan XKP016N", available from BASF Japan Ltd.; and trade name "Rezamin P4585LS" and trade name "Rezamin PS62490", available from Dainichiseika Color & Chemicals Mfg. Co., Ltd.

Other resin may be used in combination with the thermoplastic polyurethane elastomer in the cover 10. Examples of the other resin include thermoplastic polyester elastomers, thermoplastic polyamide elastomers, thermoplastic polyolefin elastomers, thermoplastic polystyrene elastomers and ionomer resins.

When other resin is used in combination with a thermoplastic polyurethane elastomer, the thermoplastic polyurethane elastomer is included in the base polymer as a principal component, in light of the control performance. Proportion of the thermoplastic polyurethane elastomer occupying in total base polymer is preferably equal to or greater than 50% by weight, more preferably equal to or greater than 70% by weight, and particularly preferably equal to or greater than 85% by weight.

Into the cover 10 may be blended a coloring agent such as titanium dioxide, a filler such as barium sulfate, a dispersant, an antioxidant, an ultraviolet absorbent, a light stabilizer, a fluorescent agent, a fluorescent brightening agent and the like in an appropriate amount as needed. Also, the cover 10 may be blended with powder of a highly dense metal such as tungsten, molybdenum or the like for the purpose of adjusting the specific gravity.

It is preferred that the cover 10 has a hardness Hc of equal to or less than 54. By employing such a soft cover 10, a favorable control performance may be accomplished upon a shot with a short iron. In light of the control performance, it is preferred that the hardness Hc is equal to or less than 50, and further, equal to or less than 47. In light of the flight performance upon shots with a driver, a long iron and a middle iron, it is preferred that the hardness Hc is equal to or greater than 20, still more equal to or greater than 28, and yet more equal to or greater than 33.

The hardness is measured by an automated rubber hardness scale which is equipped with a Shore D type spring hardness scale (trade name "LA1", available from Koubunshi Keiki Co., Ltd.) in accordance with a standard of "ASTM-D 2240-68". For the measurement, a slab which is formed by hot press and having a thickness of about 2 mm is used. Prior to the measurement, the slab is stored at a temperature of 23° C. for two weeks. When the measurement is carried out, three slabs are overlaid. The slab comprising the same resin composition as the cover is used.

The cover 10 has a nominal thickness Tc of 0.1 mm or greater and 0.9 mm or less. Forming a cover 10 with a nominal thickness Tc of equal to or less than 0.1 mm is difficult. By setting the nominal thickness Tc to be equal to or less than 0.9 mm, the cover 10 does not adversely affect the resilience coefficient to a large extent upon a shot with a driver, even though the cover 10 has a low hardness. In this respect, the nominal thickness Tc is more preferably equal to or less than 0.5 mm and particularly preferably equal to or less than 0.4 mm. When a golf ball is assumed as being a globe, polar coordinate is represented by (θ,ϕ) in which θ is latitude; and ϕ is longitude. Twelve reference points having the polar coordinate of (10, 0), (25, 0), (40, 0), (55, 0), (70, 0), (85, 0), (10, 90), (25, 90), (40, 90), (55, 90), (70, 90) and (85, 90) are selected, and the thickness of the cover 10 is measured immediately below the land 14 positioned at the nearest to these reference points. Mean value of thus resulting data from 12 points is the nominal thickness Tc.

Figure 2:
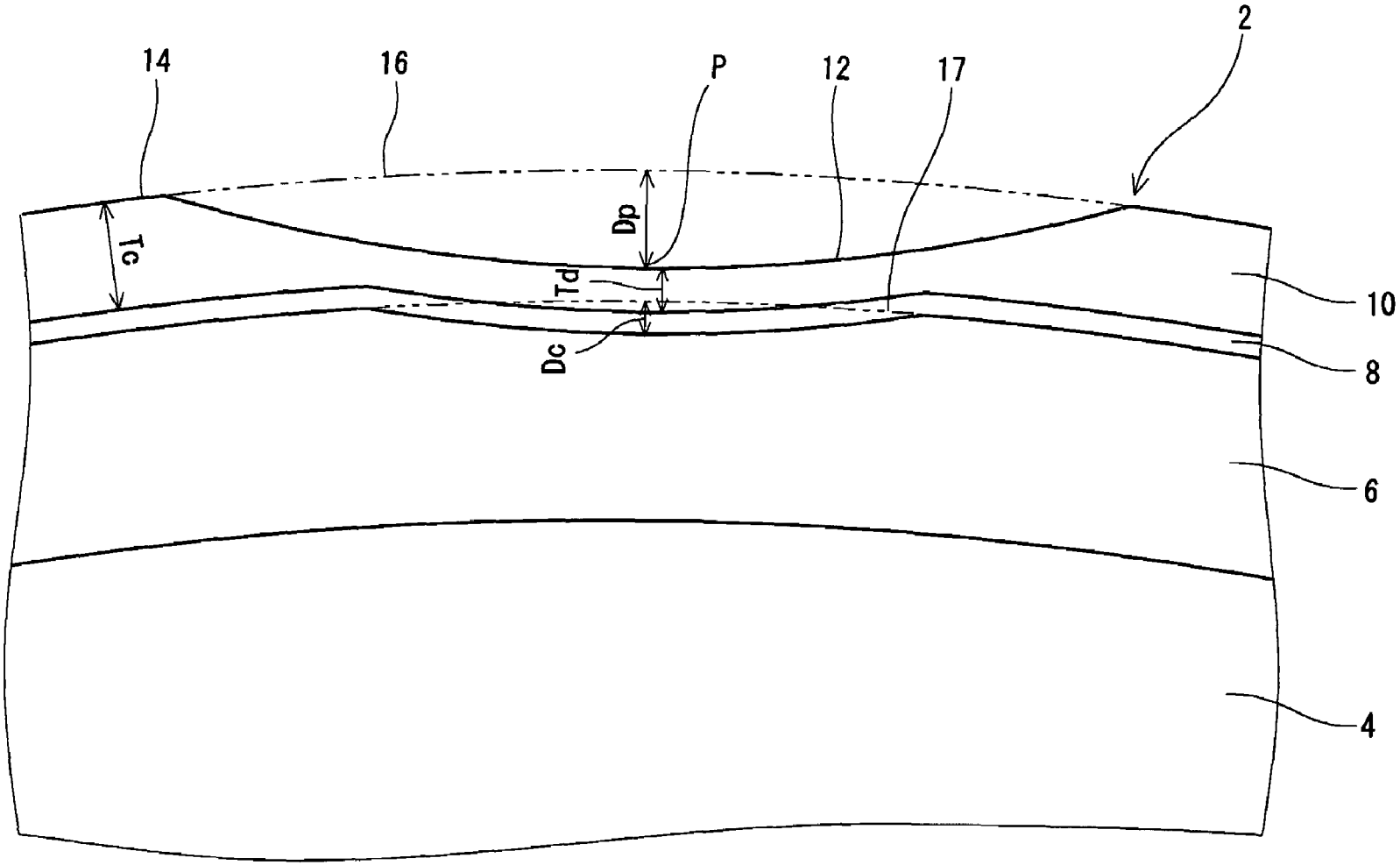
FIG. 2 is an enlarged cross-sectional view illustrating a part of the golf ball shown in FIG. 1.

FIG. 2 is an enlarged cross-sectional view illustrating a part of the golf ball 2 shown in FIG. 1. In this Figure, a cross section along a plane passing through a deepest place P of the dimple 12 and the center of the golf ball 2 is shown. A top-to-bottom direction in FIG. 2 is an in-depth direction of the dimple 12. The in-depth direction is a direction from the weighted center of area of the dimple 12 toward the center of the golf ball 2. What is indicated by a chain double-dashed line 16 in FIG. 2 is a phantom sphere. The surface of the phantom sphere 16 corresponds to a surface of the golf ball 2 when it is postulated that there is no dimple 12 existed. The dimple 12 is recessed from the phantom sphere 16. The land 14 agrees with the phantom sphere 16.

What is indicated by a both-sided arrowhead Dp in FIG. 2 is depth of the dimple 12. The depth Dp is a distance between the phantom sphere 16 and the deepest site P. What is indicated by a both-sided arrowhead Td in FIG. 2 is a thickness of the cover 10 immediately below the deepest site P. Because the dimples 12 are recessed from the phantom sphere 16 as described above, the thickness Td is smaller than the nominal thickness Tc. Accordingly, the cover 10 immediately below the deepest site P is thin. Generally, thinner part among the cover 10 is liable to be cut upon impact of a golf ball with a short iron. In the golf ball 2 shown in FIG. 2, the mid layer 6 and the reinforcing layer 8 are recessed immediately below the deepest site P.

What is indicated by a both-sided arrowhead Dc in FIG. 2 is a depth of the recess. The thickness Td of the cover 10 is greater than (Tc−Dp). The nominal thickness Tc of the cover 10 is extremely small as described above, however, separating, cutting and cracks are suppressed because the thickness Td is set to be greater than (Tc−Dp). This golf ball 2 is excellent in durability irrespective of the thickness of the cover 10 being extremely small, and of the cover 10 being soft. Also, the mid layer 6 and the reinforcing layer 8 are not exposed because the thickness Td is set to be greater than (Tc−Dp). And further, in this golf ball 2, the mid layer 6 and the reinforcing layer 8 are not seen through. This golf ball 2 is excellent in appearance.

In light of the durability and the appearance, proportion P1 of number of the dimples 12 on the cover 10 having a thickness Td immediately below the deepest site P of the dimple 12 of greater than (Tc−Dp), occupying in total number of the dimples 12 is preferably equal to or greater than 30%, more preferably equal to or greater than 60%, and particularly preferably equal to or greater than 80%. This proportion P1 is ideally 100%.

Figure 3:
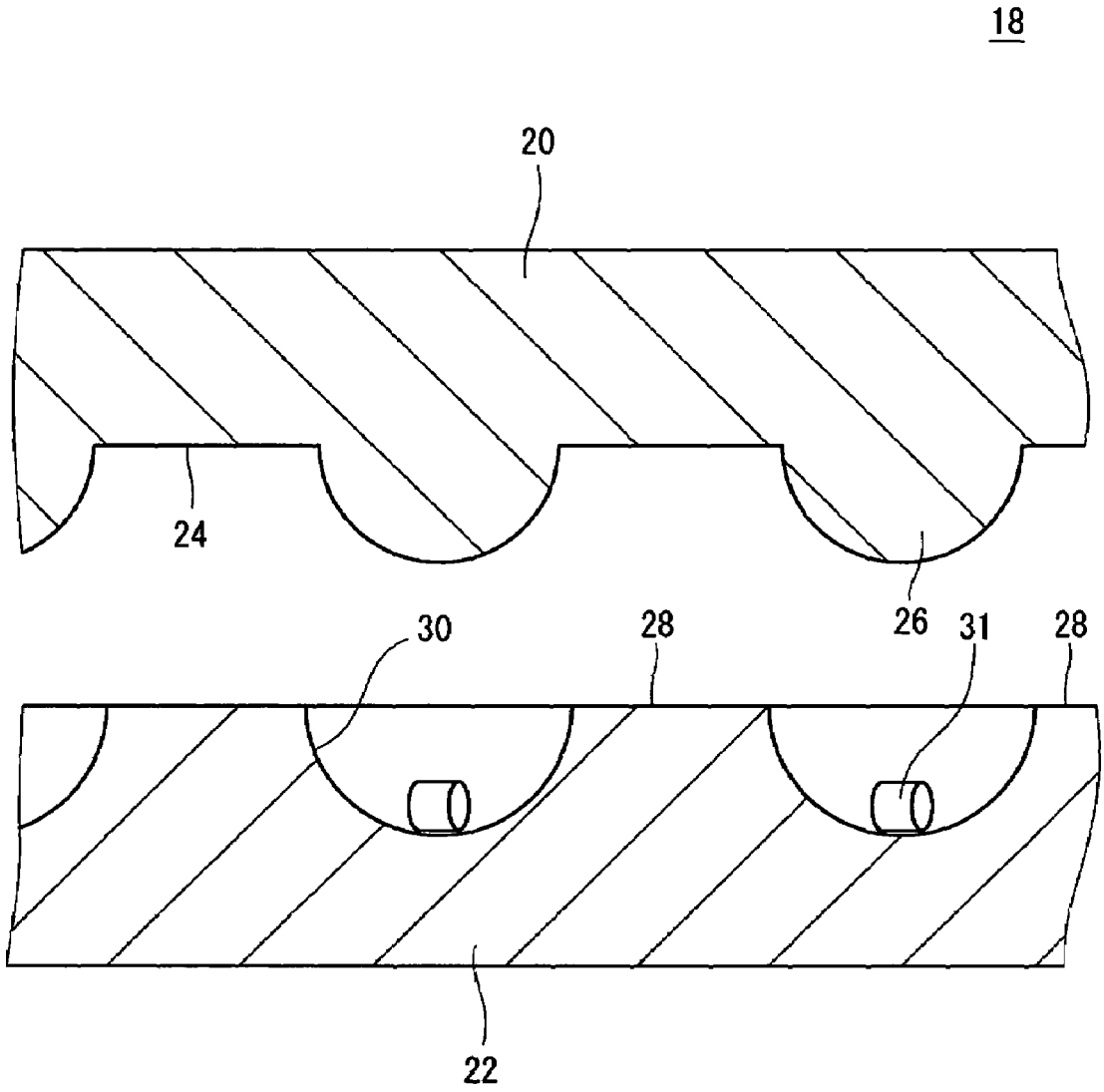
FIG. 3 is a cross-sectional view illustrating a part of a first mold for use in the production of the golf ball shown in FIG. 1.

FIG. 3 is a cross sectional view illustrating a part of a first mold 18 for use in the production of the golf ball 2 shown in FIG. 1. The first mold 18 has an upper mold half 20 and a lower mold half 22. The upper mold half 20 has a flat part 24 and a spherical protruding part 26. The lower mold half 22 has a flat part 28 and a spherical recessed part 30. The protruding part 26 has a radius that is smaller than the radius of the recessed part 30. When the upper mold half 20 and the lower mold half 22 are mated, a space is formed between the protruding part 26 and the recessed part 30. When the upper mold half 20 and the lower mold half 22 are mated, a space is formed also between the flat part 24 of the upper mold half 20 and the flat part 28 of the lower mold half 22.

Figure 4:
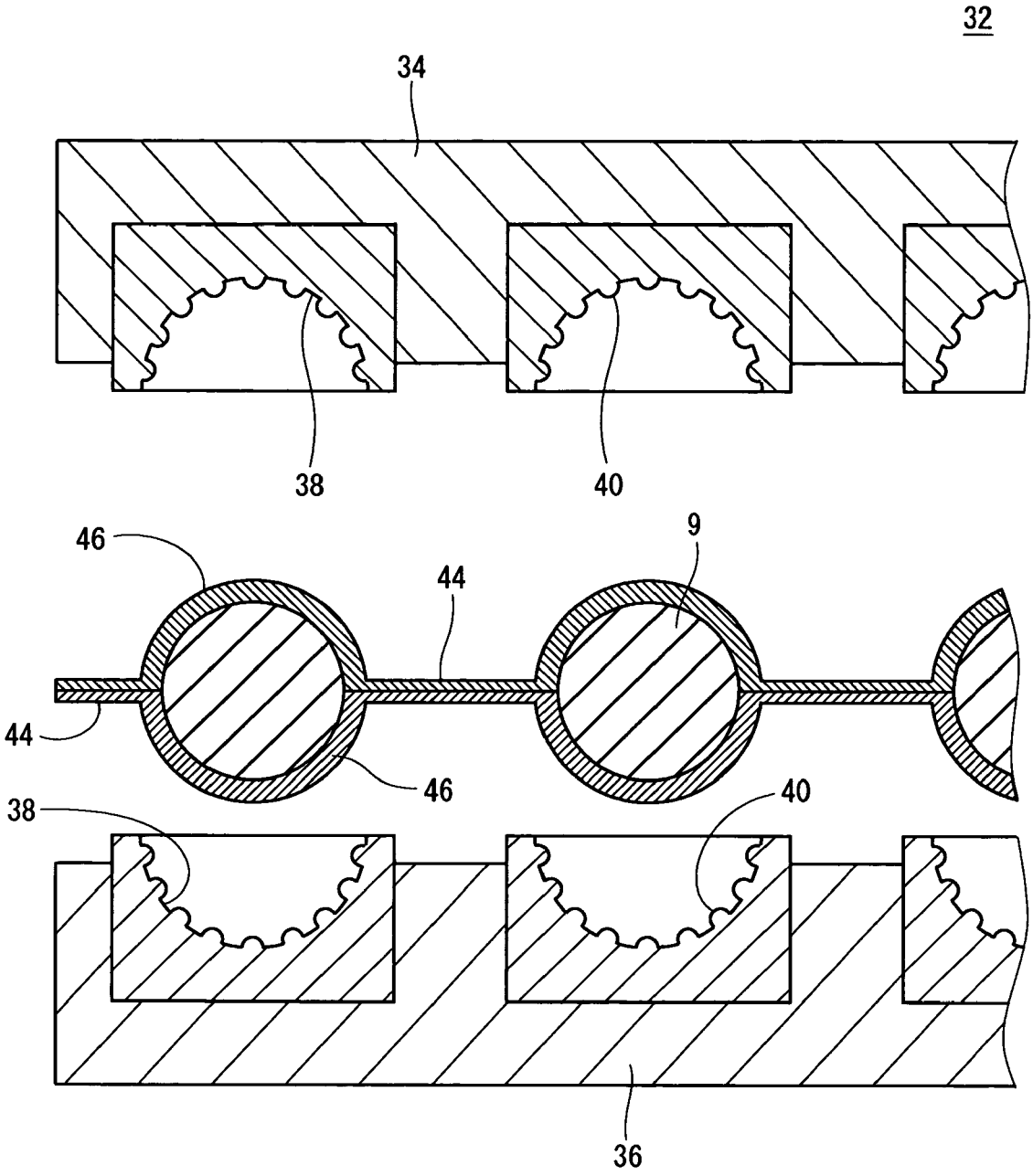
FIG. 4 is a cross-sectional view illustrating a part of a second mold for use in the production of the golf ball shown in FIG. 1.

FIG. 4 is a cross sectional view illustrating a part of a second mold 32 for use in the production of the golf ball 2 shown in FIG. 1. The second mold 32 has an upper mold half 34 and a lower mold half 36. Each of the upper mold half 34 and the lower mold half 36 has numerous cavity faces 38, respectively. Inside of these cavity faces 38 are hemispherical. When the upper mold half 34 and the lower mold half 36 are mated, spherical cavities are formed. Inside of the cavity faces 38, numerous convex pimples 40 are formed.

Upon the production method of the present embodiment, a base rubber, a crosslinking agent and various additives are first kneaded to obtain a rubber composition. Next, this rubber composition is placed into a mold for a center having an upper mold half and a lower mold half, and having a spherical cavity (not shown in the Figure). Next, this mold is clamped, and the rubber composition is heated via the mold. Heating causes a crosslinking reaction of the rubber. The rubber composition is cured through crosslinking. The mold is released, and a spherical center 4 is removed.

This center 4 is placed into a mold for a mid layer (not shown in the Figure) having an upper mold half and a lower mold half, and having a spherical cavity. A melted mid layer material (a melted resin composition) including a thermoplastic resin, and with a melting point of equal to or greater than 95° C. is injected around this center 4 according to injection molding. This material is hardened to form the mid layer 6. The mid layer 6 may be formed also by compression molding.

Next, a liquid comprising a base material and a curing agent dissolved or dispersed in a solvent is applied on the surface of the mid layer 6 with a spray gun. The solvent is volatilized after the application to permit a reaction of the base material with the curing agent thereby forming the reinforcing layer 8. Thus, a core 9 comprising the center 4, the mid layer 6 and the reinforcing layer 8 is obtained.

Next, a thermoplastic resin and additives are blended, and extruded from an extruder to give a cover material (a resin composition). This resin composition is cut into a predetermined size and pellets 31 are obtained (see, FIG. 3). Next, the pellet 31 is placed into the first mold 18. As shown in FIG. 3, the pellet 31 is put on the recessed part 30 of the lower mold half 22. Next, the lower mold half 22 is relatively elevated toward the upper mold half 20, and clamping is carried out. The clamping is usually carried out with a pressing machine. According to the clamping, the pellet 31 is compressed, and heated. The compression and heating results in flow of the resin composition, thereby filling the space between the upper mold half 20 and the lower mold half 22 with the resin composition. Next, the first mold 18 is cooled. By cooling, temperature of the resin composition is also lowered. When the temperature is lowered enough, the first mold 18 is released to remove a preforming material. As shown in FIG. 4, the preforming material 44 has numerous half shells 46. The half shell 46 is bowl-shaped. The half shell 46 may be formed also by injection molding.

Next, as shown in FIG. 4, the core 9 is sandwiched between two pieces of the preforming material 44. The core 9 is covered by two pieces of the half shell 46. Next, the preforming material 44 and the core 9 are placed into the second mold 32. The core 9 and the half shell 46 are usually put on the cavity face 38 of the lower mold half 36.

Next, the lower mold half 36 is relatively elevated toward the upper mold half 34, and the mold 32 is clamped. The clamping is usually carried out with a pressing machine. According to the clamping, the half shell 46 is compressed, and heated. The compression and heating results in flow of the resin composition of the half shell 46, thereby covering around the core 9. Excess resin composition flows out from the spherical cavity. However, the resin composition of the mid layer 6 hardly flows out.

Next, the second mold 32 is cooled. By cooling, temperature of the resin composition is also lowered. When the temperature is lowered enough, the second mold 32 is released, and a golf ball 2 is removed. This golf ball 2 has a cover 10 comprising a resin composition. On the surface of the cover 10 are formed dimples 12 having a shape inverted from the shape of pimples 40.

When forming the cover 10, the pimple 40 also presses the reinforcing layer 8 and the mid layer 6. According to the pressing, the reinforcing layer 8 and the mid layer 6 are recessed. The recession promotes flow of the resin composition of the cover 10 during compression and heating. Because the reinforcing layer 8 and the mid layer 6 have recessed parts corresponding to the dimples 12, the cover 10 has a sufficient thickness immediately below the dimples 12. The cover 10 is excellent in durability. This golf ball 2 is also excellent in appearance because the resin composition of the mid layer 6 does not flow out.

When the incipient fluidization temperature of the material for the cover 10 is set to be Tk, the molding temperature Tf is preferably equal to or greater than (Tk−50) (° C.) on this production method. By setting the temperature Tf to be equal to or greater than (Tk−50) (° C.) the half shell 46 is sufficiently deformed and the dimple 12 may be formed. The temperature Tf is preferably equal to or less than (Tk+30) (° C.). By setting the temperature Tf to be equal to or less than (Tk+30) (° C.), excess flow of the resin composition of the half shell 46 is suppressed. By setting the temperature Tf to be equal to or less than (Tk+30) (° C.), outflow of the resin composition of the mid layer 6 is suppressed. The temperature Tf means the maximum temperature attained by the second mold 32 during the time period of from the step of placing the core 9 to the step of hardening the cover 10. The incipient fluidization temperature Tk is measured by "FLOWSTER CFT-500", available from Shimadzu Corporation. Measurement conditions are as shown below.

Plunger area: 1 $cm^2$
DIE LENGTH: 1 mm
DIE DIA: 1 mm
Load: 588.399 N
Initiation temperature: 30° C.
Temperature elevation rate: 3° C./min

EXAMPLES

Example 1

A rubber composition was obtained by kneading 100.0 parts by weight of polybutadiene (trade name "BR18", available from JSR Corporation), 35.0 parts by weight of zinc diacrylate, 5.0 parts by weight of zinc oxide, 13.4 parts by weight of barium sulfate, 0.8 part by weight of diphenyldisulfide (available from Sumitomo Seika Chemical Company Limited) and 0.5 part by weight of dicumyl peroxide (available from NOF Corporation). This rubber composition was placed into a mold having upper and lower mold half each having a hemispherical cavity, and heated under a temperature of 170° C. for 15 minutes to obtain a center having a diameter of 38.5 mm.

A type e resin composition shown in Table 1 below was obtained with a biaxial extruder. Around the center was covered with this resin composition by injection molding to give a mid layer. This mid layer had a thickness Tm of 1.6 mm.

TABLE 1

| Specification of mid layer (parts by weight) | | | | | |
|---|---|---|---|---|---|
| Type | a | b | c | d | e |
| Himilan 1652 *1 | — | 30 | 40 | 60 | 50 |
| Himilan AM79102 *2 | — | 50 | 50 | 20 | 50 |
| Himilan 1605 *3 | 50 | — | — | — | — |
| Himilan AM7329 *4 | 50 | 20 | 10 | 20 | — |
| Melting point Tt (° C.) | 92 | 95 | 96 | 97 | 99 |

*1 Binary ionomer neutralized with zinc
Melting point: 98° C.
Du Pont-MITSUI POLYCHEMICALS Co., Ltd.
*2 Binary ionomer neutralized with zinc
Melting point: 102° C.
Du Pont-MITSUI POLYCHEMICALS Co., Ltd.
*3 Binary ionomer neutralized with zinc
Melting point: 102° C.
Du Pont-MITSUI POLYCHEMICALS Co., Ltd.
*4 Binary ionomer neutralized with zinc
Melting point: 102° C.
Du Pont-MITSUI POLYCHEMICALS Co., Ltd.

A coating composition containing a two-component cured epoxy resin as a base polymer (trade name "POLIN 750LE", available from Shinto Paint Co., Ltd.) was prepared. The base material liquid of this coating composition consists of 30 parts by weight of a bisphenol A type solid epoxy resin and 70 parts by weight of a solvent. The curing agent liquid of this coating composition consists of 40 parts by weight of denatured polyamide amine, 55 parts by weight of a solvent and 5 parts by weight of titanium oxide. Weight ratio of the base material liquid and the curing agent liquid is 1/1. This coating composition was applied on the surface of the mid layer with a spray gun, and kept in an atmosphere of 40° C. for 24 hours to give a reinforcing layer.

A pellet formed resin composition was obtained by kneading 100 parts by weight of thermoplastic polyurethane elastomer (aforementioned "Elastollan XNY97A", incipient fluidization temperature Tk: 130° C.) and 4 parts by weight of titanium dioxide in a biaxial kneading extruder. Half shells were obtained from this resin composition with compression molding using a first mold. The core was covered by the two pieces of the half shells, and placed into a second mold to obtain a cover with compression molding. Compression was made with two steps. Conditions of the first step are as follows.

Molding temperature Tf: 140° C.
Pressure: 10 MPa
Duration: 180 seconds

Conditions of the second step are as follows.

Cooling temperature: 0° C.
Pressure: 10 MPa
Duration: 300 seconds

A golf ball of Example 1 was obtained by making pretreatment and applying clear paint on the cover. This golf ball had a diameter of 42.7 mm and a cover with a nominal thickness Tc of 0.50 mm.

Examples 2 to 4 and Comparative Example

In a similar method of manufacture to Example 1 except for using resin compositions for a mid layer according to the following Table 2, golf balls of Examples 2 to 4 and Comparative Example were obtained. The specifications of the resin compositions are shown in the Table 1 above.

TABLE 2

| | | Results of evaluation | | | | |
|---|---|---|---|---|---|---|
| | | Example 1 | Example 2 | Example 3 | Example 4 | Compa. Example |
| Center | Diameter (mm) | 38.5 | 38.5 | 38.5 | 38.5 | 38.5 |
| Mid layer | Type | e | d | c | b | a |
| | Thickness Tm (mm) | 1.6 | 1.6 | 1.6 | 1.6 | 1.6 |
| | Depth of recessed part Dc (mm) | 0.07 | 0.07 | 0.07 | 0.07 | 0.07 |
| | Melting point Tt (° C.) | 99 | 97 | 96 | 95 | 92 |
| Core | Diameter (mm) | 41.7 | 41.7 | 41.7 | 41.7 | 41.7 |
| Cover | Thickness Tc (mm) | 0.50 | 0.50 | 0.50 | 0.50 | 0.50 |
| | Thickness Td (mm) | 0.39 | 0.39 | 0.39 | 0.39 | 0.39 |
| | Difference Tc − Td (mm) | 0.11 | 0.11 | 0.11 | 0.11 | 0.11 |
| Dimple | Depth Dp (mm) | 0.18 | 0.18 | 0.18 | 0.18 | 0.18 |
| Golf ball | Diameter (mm) | 42.7 | 42.7 | 42.7 | 42.7 | 42.7 |
| Ratio (Dc/Dp) | | 39 | 39 | 39 | 39 | 39 |
| Appearance | | A | B | B | B | C |
| Durability | | 136 | 112 | 108 | 100 | 78 |

[Measurement of Melting Point]

The melting point Tt of a resin composition for a mid layer was measured with DSC.

[Evaluation of Appearance]

The seam line was visually observed, and the appearance was graded according to the following standard.

A: No outflow of the mid layer is visible
B: Outflow of the mid layer is slightly visible
C: Outflow of the mid layer is highly visible

[Evaluation of Durability]

A driver with a metal head was attached to a swing robot available from True Temper Co. The golf balls were rendered to hit repeatedly on a metal plate at a velocity of 45 m/s, and the number of times of the hitting until the golf ball was broken was counted. The number of times of the hitting in Example 4 was set as 100, and the number of times of the hitting in other Examples was expressed with index numbers.

The mid layer of the golf balls in each Example and Comparative Example has recessed parts which correspond to each of the dimples. The thickness immediately below the dimple is sufficiently great. Accordingly, the bottom of the dimple has a favorable appearance, and the cover is not easily cut at the bottom of the dimple. In the golf balls in each Example, the resin composition of the mid layer has a melting point Tt of equal to or greater than 95° C. Accordingly, the resin composition of the mid layer does not easily flow out when molding the cover. The golf balls in each Example have favorable appearance of the seam line. In addition, the golf balls in each Example do not easily crack from the seam when the golf balls are repeatedly hit. The golf balls in each Example are excellent in appearance and durability. Accordingly, advantages of the present invention are clearly indicated by these results of evaluation.

The present invention can be applicable to golf balls having a layer comprising one or more resin compositions or rubber compositions between a center and a mid layer. The description hereinabove is merely for illustrative examples, and various modifications can be made without departing from the principles of the present invention.

What is claimed is:

1. A method of the production of a golf ball which comprises:

a first step in which a spherical center is formed;

a second step in which a mid layer material including a thermoplastic resin and having a melting point of equal to or greater than 95° C. is prepared;

a third step in which said center is covered by said mid layer material to form a mid layer;

a fourth step in which a material for a cover comprising a thermoplastic resin is prepared;

a fifth step in which a half shell is formed by said cover material;

a sixth step in which a core comprising said center and said mid layer is covered by two half shells and placed into a mold having numerous pimples; and a seventh step in which said core and said half shells are compressed and heated in the mold, said pimples form dimples on the surface of the cover, and said pimples simultaneously form recessed parts on the mid layer which correspond to all the dimples, and a cover is formed having a thickness Td immediately below the deepest site of each dimple being greater than a difference between a nominal thickness Tc and a depth of each dimple (Tc−Dp).

2. The method of the production according to claim 1 wherein the mid layer material which is prepared in said second step, includes an ionomer resin.

3. The method of the production according to claim 1 wherein a melted mid layer material is injected around the center which is held in a mold.

4. The method of the production according to claim 1 wherein said third step comprises a step in which the center is covered by two half shells comprising the mid layer material, and a step in which the center and the half shells are compressed and heated in the mold.

5. The method of the production according to claim 2 wherein the mid layer material which is prepared in said second step, includes an ionomer resin having a melting point of equal to or greater than 102° C.

6. The method of the production according to claim 1 wherein the nominal thickness Tc is 0.1 mm or greater and 0.9 mm or less.

7. The method of the production according to claim 1 wherein the nominal thickness Tc is 0.1 mm or greater and 0.5 mm or less.

* * * * *